US009204696B2

(12) United States Patent
Tseng et al.

(10) Patent No.: US 9,204,696 B2
(45) Date of Patent: Dec. 8, 2015

(54) SUITCASE STRUCTURE

(71) Applicant: TWINKLE LEATHERWARE CO., LTD., Kwai Chung (HK)

(72) Inventors: Tzu-Wei Tseng, Kwai Chung (HK); Hung-Sheng Lin, Kwai Chung (HK); Cheng-Cheng Chen, Kwai Chung (HK); Yi-Ju Hsieh, Kwai Chung (HK); Wai-Ming Wong, Kwai Chung (HK)

(73) Assignee: TWINKLE LEATHERWARE CO., LTD., Kwai Chung (HK)

( * ) Notice: Subject to any disclaimer, the term of this patent is extended or adjusted under 35 U.S.C. 154(b) by 42 days.

(21) Appl. No.: 13/855,856

(22) Filed: Apr. 3, 2013

(65) Prior Publication Data

US 2014/0299429 A1 Oct. 9, 2014

(51) Int. Cl.

| | |
|---|---|
| ***A45C 5/02*** | (2006.01) |
| ***A45C 5/14*** | (2006.01) |
| ***A45C 7/00*** | (2006.01) |
| ***A45C 13/10*** | (2006.01) |

(52) U.S. Cl.

CPC ... *A45C 5/02* (2013.01); *A45C 5/14* (2013.01); *A45C 7/0036* (2013.01); *A45C 13/103* (2013.01)

(58) Field of Classification Search

CPC ..... A45C 7/009; A45C 5/02; A45C 7/0036; A45C 13/103

USPC ..... 190/103, 106, 107, 901, 903, 119, 122; 383/2, 4, 33; 220/4.29, 6

See application file for complete search history.

(56) References Cited

U.S. PATENT DOCUMENTS

| | | | | |
|---|---|---|---|---|
| 1,817,518 | A * | 8/1931 | Lacher | 190/119 |
| 2,778,397 | A * | 1/1957 | Carrasco | 190/119 |
| 3,295,643 | A * | 1/1967 | Peterson et al. | 190/119 |
| 4,598,802 | A * | 7/1986 | Abenaim | 190/107 |
| 4,678,088 | A * | 7/1987 | Flum | 211/73 |
| 4,932,506 | A * | 6/1990 | Kim | 190/111 |
| 6,601,743 | B2 * | 8/2003 | Godshaw | 224/153 |
| 7,175,010 | B1 * | 2/2007 | Miner | 190/107 |
| 8,079,451 | B2 * | 12/2011 | Rothschild et al. | 190/107 |
| 2004/0238609 | A1 * | 12/2004 | Goglio | 229/109 |
| 2005/0034948 | A1 * | 2/2005 | Tiramani | 190/107 |
| 2009/0120752 | A1 * | 5/2009 | Bettua et al. | 190/18 A |
| 2010/0101908 | A1 * | 4/2010 | Chun | 190/18 A |

FOREIGN PATENT DOCUMENTS

| | | | |
|---|---|---|---|
| WO | WO 2013/056392 | A1 * | 4/2013 |
| WO | WO 2014/127497 | A1 * | 8/2014 |

* cited by examiner

*Primary Examiner* — Sue A Weaver

(74) *Attorney, Agent, or Firm* — Maschoff Brennan

(57) ABSTRACT

A suitcase structure includes a back case component, a front lid component and a ring-shaped gusset component. The opposite sides of the ring-shaped gusset component are connected with the edge of the back case component and the edge of the front lid component, so as to form an accommodating space. The ring-shaped gusset component has multiple first supporting parts and multiple second supporting parts connected to each other. The first supporting parts are each located at each of the end corners of the back case component. The second supporting parts are each located at each of the lateral edges of the back case component.

10 Claims, 19 Drawing Sheets

10

SUITCASE STRUCTURE

TECHNICAL FIELD

The disclosure relates to a suitcase, more particularly to a suitcase easy to be stored.

RELATED ART

Before long distance travels, travelers are used to putting all the things needed during the journey in a suitcase. Due to the limit of suitcase's capacity, travelers, however, usually can only store the relatively important belongings in the suitcase and the relatively not important belongings can only be left. Travelers need to buy necessities which cannot be stored in the suitcase after arriving the destinations. Therefore, to avoid the waste caused by repeat purchases of the same necessities, travelers are often fond of high capacity suitcases, in order to store plenty of personal belongings in those suitcases.

Although the high capacity suitcase is able to accommodate more belongings, it may cause storage problems for travelers after their travels. For those families with limited storage spaces, they are particularly troubled by the storage of big suitcases.

Consequently, in order to store suitcases more conveniently, how to make a suitcase with the feature that the size thereof can be reduced after the travels is a problem to be solved for the designers.

SUMMARY

In an embodiment, a suitcase structure comprises a back case component, a front lid component and a ring-shaped gusset component. The opposite sides of the ring-shaped gusset component are connected with the edge of the back case component and the edge of the front lid component, so as to form an accommodating space, the ring-shaped gusset component having a plurality of first supporting parts and a plurality of second supporting parts connected with each other. The plurality of first supporting parts are each located at each of the end corners of the back case component. The plurality of second supporting parts are each located at each of the lateral edges of the back case component. The ring-shaped gusset component has a plurality of bending parts. The plurality of bending parts are each located between the plurality of first supporting parts and the plurality of second supporting parts. The flexible deformation capability of each of the bending parts is greater than the flexible deformation capability of each of the first supporting parts and each of the second supporting parts. The plurality of bending parts are bendable, making the plurality of first supporting parts and the plurality of second supporting parts be capable of being stacked oppositely or being erected on the back case component.

In another embodiment, a suitcase structure comprises a back case component, a front lid component and a ring-shaped gusset component. The opposite two sides of the ring-shaped gusset component are connected to the edge of the back case component and the edge of the front lid component respectively, so as to form an accommodating space.

The ring-shaped gusset component has a plurality of bending sections and a plurality of sidewall sections. Each of the bending sections is located at each of the end corners of the back case component. Each of the sidewall sections is located at each of the lateral edges of the back case component. The flexible deformation capability of each of the bending sections is greater than the flexible deformation capability of each of the sidewall sections. The plurality of bending sections are bendable, making the plurality of sidewall sections be capable of being stacked oppositely or being erected on the back case component.

In still another embodiment, a suitcase structure comprises a back case component, a front lid component and a ring-shaped gusset component. The opposite two sides of the ring-shaped gusset component are connected to the edge of the back case component and the edge of the front lid component respectively, so as to form an accommodating space. The ring-shaped gusset component has a plurality of first accommodating parts and a plurality of first reinforcement elements. Each of the first accommodating parts is located at each lateral edge of the back case component. Each of the first accommodating parts is kept apart from each other by a distance. Each of the first reinforcement elements is detachably disposed on each of the first accommodating parts, so as to form a plurality of bending parts between the first accommodating parts. The flexible deformation capability of each of the bending parts is greater than the flexible deformation capability of each of the accommodating parts. The plurality of bending sections are bendable, making the plurality of first accommodating parts be capable of being stacked oppositely or being erected on the back case component.

BRIEF DESCRIPTION OF THE DRAWINGS

The present disclosure will become more fully understood from the detailed description given herein below for illustration only, and thus does not limit the present disclosure, wherein.

DETAILED DESCRIPTION

Figure 1:
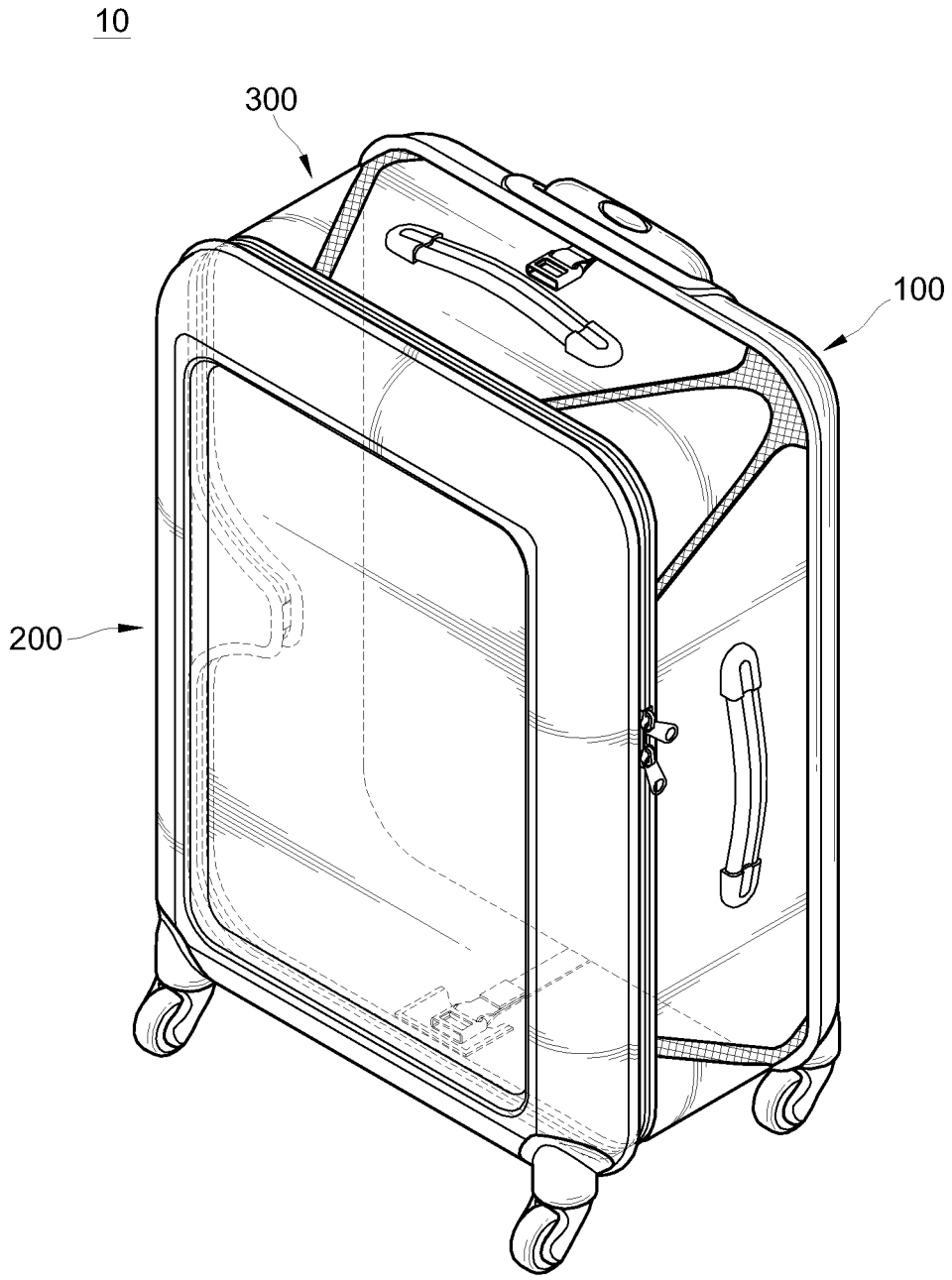
FIG. 1 is a perspective view of a suitcase structure in which the first belt body thereof is removed according to the first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
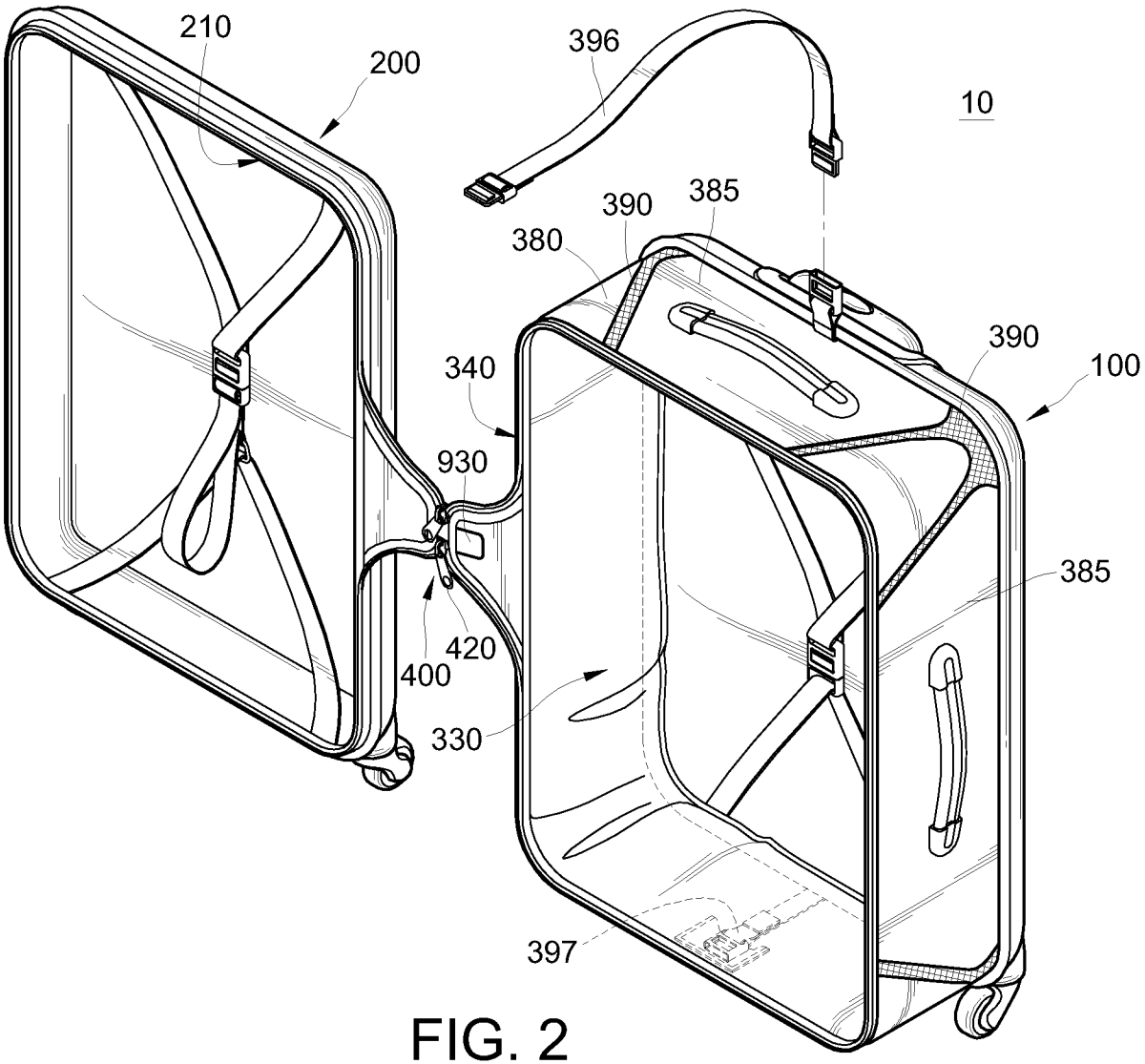
FIG. 2 is a perspective view of an opened suitcase structure of FIG. 1.
Figure 3A:
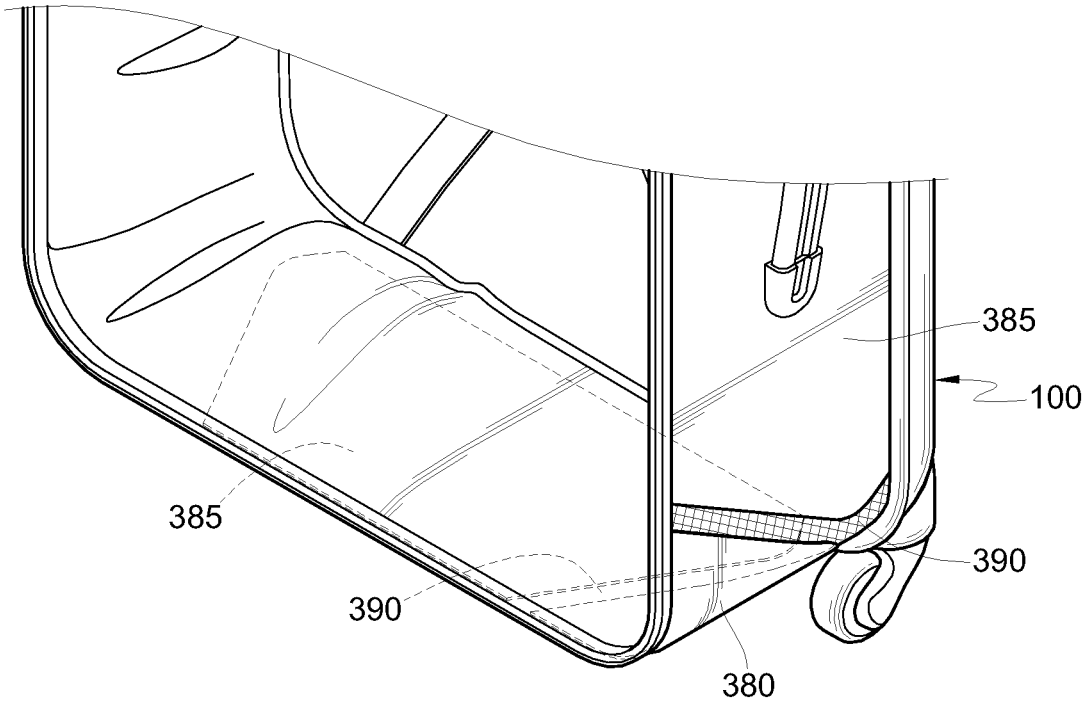
FIG. 3A is a partial enlarged view of FIG. 2.
Figure 3B:
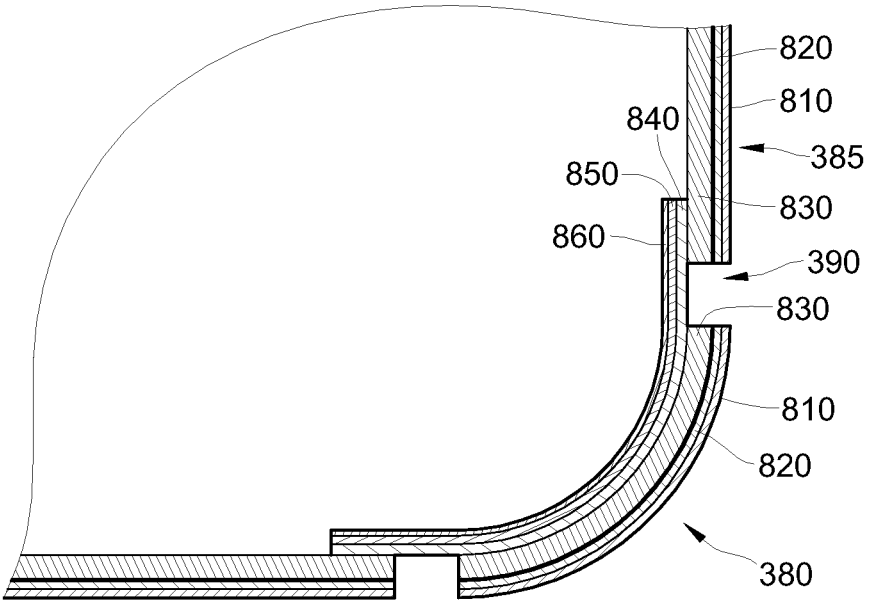
FIG. 3B is a cross section view of FIG. 3A.
Figure 3C:
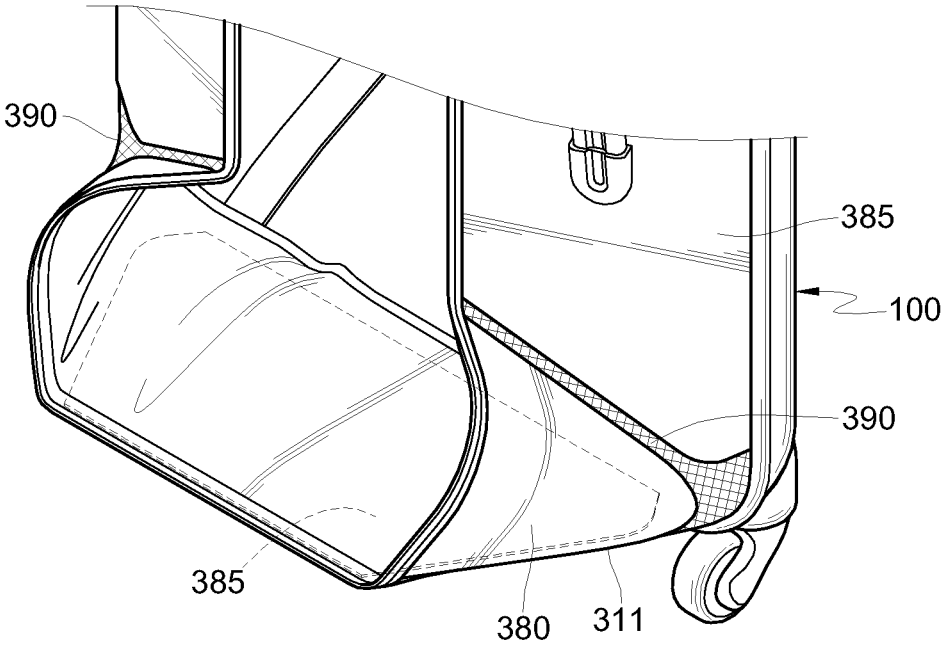
FIG. 3C is perspective view of FIG. 3A after being bended.
Figure 4:
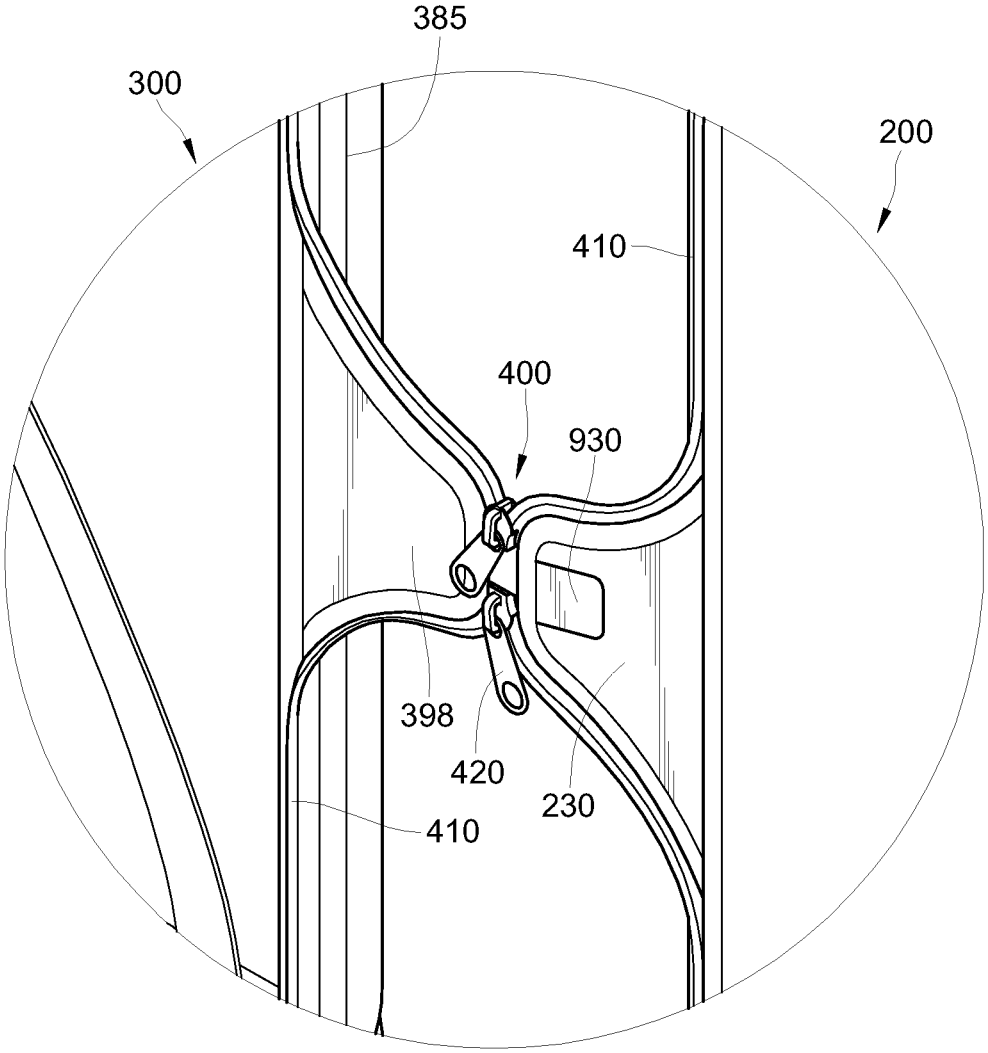
FIG. 4 is an enlarged view of the zipper part of FIG. 2.

Please refer to FIG. 1 to FIG. 4. FIG. 1 is a perspective view of a suitcase structure according to the first embodiment of the disclosure. FIG. 2 is a perspective view of an opened suitcase structure of FIG. 1. FIG. 3A is a partial enlarged view of FIG. 2. FIG. 3B is a cross section view of FIG. 3A. FIG. 3C is perspective view of FIG. 3A after being bended. FIG. 4 is an enlarged view of the zipper part of FIG. 2.

In this embodiment, a suitcase structure 10 comprises a back case component 100, a front lid component 200 and a ring-shaped gusset component 300. The back case component 100 and the front lid component 200 are made by relatively harder materials due to the better protection. For example, they are made by plastic plates such as polyethylene (PE), polypropylene (PP), ethylene-vinyl acetate (EVA), polyvinyl chloride (PVC) or acrylonitrile butadiene styrene (ABS) resin, or made by fabrics.

The opposite two sides of the ring-shaped gusset component 300 are connected to the edge of the back case component 100 and the edge of the front lid component 200 respectively, to form an accommodating space 330. Specifically, in this embodiment, the ring-shaped gusset component 300 is made by composite materials, for example, the combination of plastic plates such as PE, PVC, PP, EVA or ABS and relatively softer materials such as polyurethane (PU), rubber, thermoplastic polyurethane (TPU), Sandwich Mesh Fabric, neoprene, polyester, thermoplastic rubbers (TPR), webbing, or leather. In detail, the ring-shaped gusset component 300 has a plurality of first supporting parts 380 and a plurality of second supporting parts 385, which are connected with each other. Each of the first supporting parts 380 is located at each of the end corners of the back case component 100, while each of the second supporting parts 385 is located at each of lateral edges of the back case component 100. The inner material of the first supporting part 380 and the second supporting part 385 is, for example, the iron wire frame, the wood plate, the plastic plate, the iron plate, the aluminum plate or the magnesium alloy plate.

The ring-shaped gusset component 300 comprises a plurality of bending parts 390. Each of the bending parts is located between the first supporting part 380 and the second supporting part 385 which are adjacent to each other, and extends from the back case component 100 to the front lid component 200. In other words, two opposite sides of each of the bending parts 390 are connected to the first supporting part 380 and the second supporting part 385 respectively. Furthermore, the flexible deformation capability of each of the bending parts 390 is greater than that of each of the first supporting parts 380 and of each of second supporting parts 385. Additionally, the bending parts 390 are bendable, so as to make the plurality of first supporting parts 380 and the plurality of second supporting parts 385 be capable of being stacked oppositely or being erected on the back case component 100, thereby having a storage position and a use position.

In this embodiment, the first supporting part 380 is, but not limited to, made by a PVC layer 810, an EVA layer 820, a PP plate layer 830, a cane cloth layer 840, a neoprene layer 850 and a PVC bottom layer 860, which are stacked up. The second supporting part 385 is, but not limited to, made by a PVC layer 810, an EVA layer 820 and a PP plate layer 830. Moreover, each of the bending parts is disposed between the first supporting part 385 and the second supporting part 385 which are adjacent to each other. The bending part is, but not limited to, made by a cane cloth layer 840, a neoprene layer 850 and a PVC base fabric layer 860. Since the flexible deformation capability of the cane cloth layer 840, the neoprene layer 850 and the PVC base fabric layer 860 is greater than that of the PVC layer 810 and PP plate layer 830, and the cane cloth layer 840, the neoprene layer 850 and the PVC base fabric 860 are bendable, the plurality of first supporting parts 380 and the plurality of second supporting parts 385 can be movably stacked oppositely or erected on the back case component 100, and thereby having a storage position and a use position. The cane cloth player 840 is made by, for example, styrene-butadiene rubber. In this and some other embodiments, a PVC film is attached to the aforementioned PVC base fabric 860. Additionally, in this embodiment, the plate layer 830 is stitched to inside of the first supporting part 385 and the second supporting part 385, but the disclosure is not limited thereto. In other embodiments, the Pp plate layer 830 may be movably disposed on the first supporting part 385 and the second supporting part 385.

In this embodiment, the ring-shaped gusset component 300 has a first opening 340, and the front lid component 200 has a second opening 210. The ring shaped case frame component 300 further comprises a first extending part 398. The first extending part 398 is connected to the ring-shaped gusset component 300 to form the edge of the first opening 340. The front lid further comprises a second extending part 230, and the second extending part 230 is connected to the front lid component 200 to form the edge of the second opening 210. The front lid 200 is connected to the ring-shaped gusset component 300 by a zipper 400, so as to form the accommodating space 330. The zipper 400 comprises two chains 410 and two zipper heads 420. One of the two chains 410 is disposed around the edge of the first opening 340 and the edge of the first extending part 398. The other chain 410 is disposed around the edge of the second opening 210 and the edge of the second extending part 230. Two zipper heads 420 are configured for tying the two chains 410 together or separating them, so as to close or open the suitcase structure 10. The zipper head 420 may be the singe pull tab or the double pull tab, and it is not limited thereto. In this embodiment, the zipper head 420 is the double pull tab, and users may pull the inside tab or the outside tab based on the requirements to tying the two chains 410 together or separating them. Nonetheless, the zipper 400 is just one of the connection structures between the front lid component 200 and the ring-shaped gusset component 300. In other embodiments, the connection structure may be a Velcro or a button.

In this and some other embodiments, the ring-shaped gusset component 300 further comprises a belt 395. The belt 395 comprises a first belt body 396 and a second belt body 397. The first belt body 396 is detachably disposed on the outer lateral side of the ring-shaped gusset component 300, and the second belt body 397 is disposed on the outer lateral side of the ring-shaped gusset component 300 respectively, but the disclosure is not limited thereto. In other embodiments, they can be disposed on the inner lateral side of the ring-shaped gusset component 300. Or, in other embodiments, the first belt body 396 is directly connected to the outer lateral side of the ring-shaped gusset component 300, namely not detachable. When the first belt body 396 and the second belt body 397 are connected to each other, each of the first supporting parts 380 and each of the second supporting parts 385 are fixed to the storage position. Moreover, in this embodiment, the first belt body 396 and the second belt body 397 are disposed on the upper side and lower side of the ring-shaped gusset component 300 respectively, but the disclosure is not limited thereto. In other embodiment, the first belt body 396 and the second belt body 397 may be disposed on the left side and the right side of the ring-shaped gusset component 300 respectively.

Furthermore, in this and some other embodiments, the suitcase structure 10 further comprises a gripping part 930. The gripping part 930 is connected to the second extending part 230. The griping part 930 is configured for allowing users to grip it with one hand in order to fix the position of the second extending part 230. Thereby, users may use the other hand to drag the zipper head 420. However, in other embodiments, the gripping part 930 may be connected to the first extending part 398, and the disclosure is not limited thereto.

The storage process of the suitcase structure of this embodiment is illustrated hereinafter. Please refer to FIG. 2 and FIG. 5 to FIG. 8. FIG. 5 to FIG. 8 are schematic views of the storage process of FIG. 2.

Figure 5:
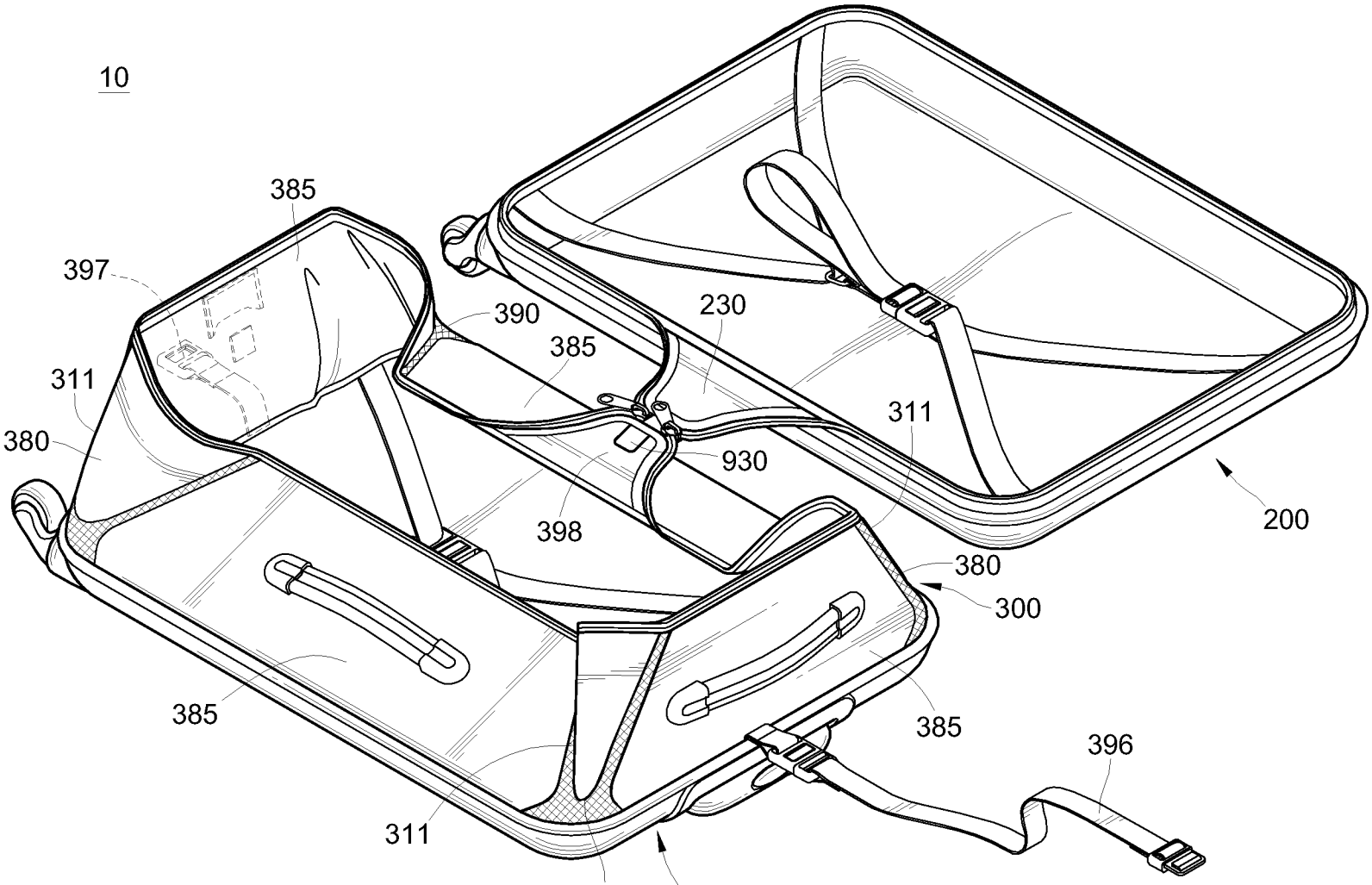
FIG. 5 to FIG. 8 are schematic views of the storage process of FIG. 2.

Firstly, according to FIG. 2, the ring-shaped case frame 300 is erected oppositely on the back case component 100 and therefore is in a use position. At this point, goods can be stored in the accommodating space 300. Subsequently, the action of folding the ring-shaped case frame 300 starts. As shown in FIG. 5, the two opposite second supporting parts 385 are first pressed inwardly to form the fold line 311.

Figure 6:
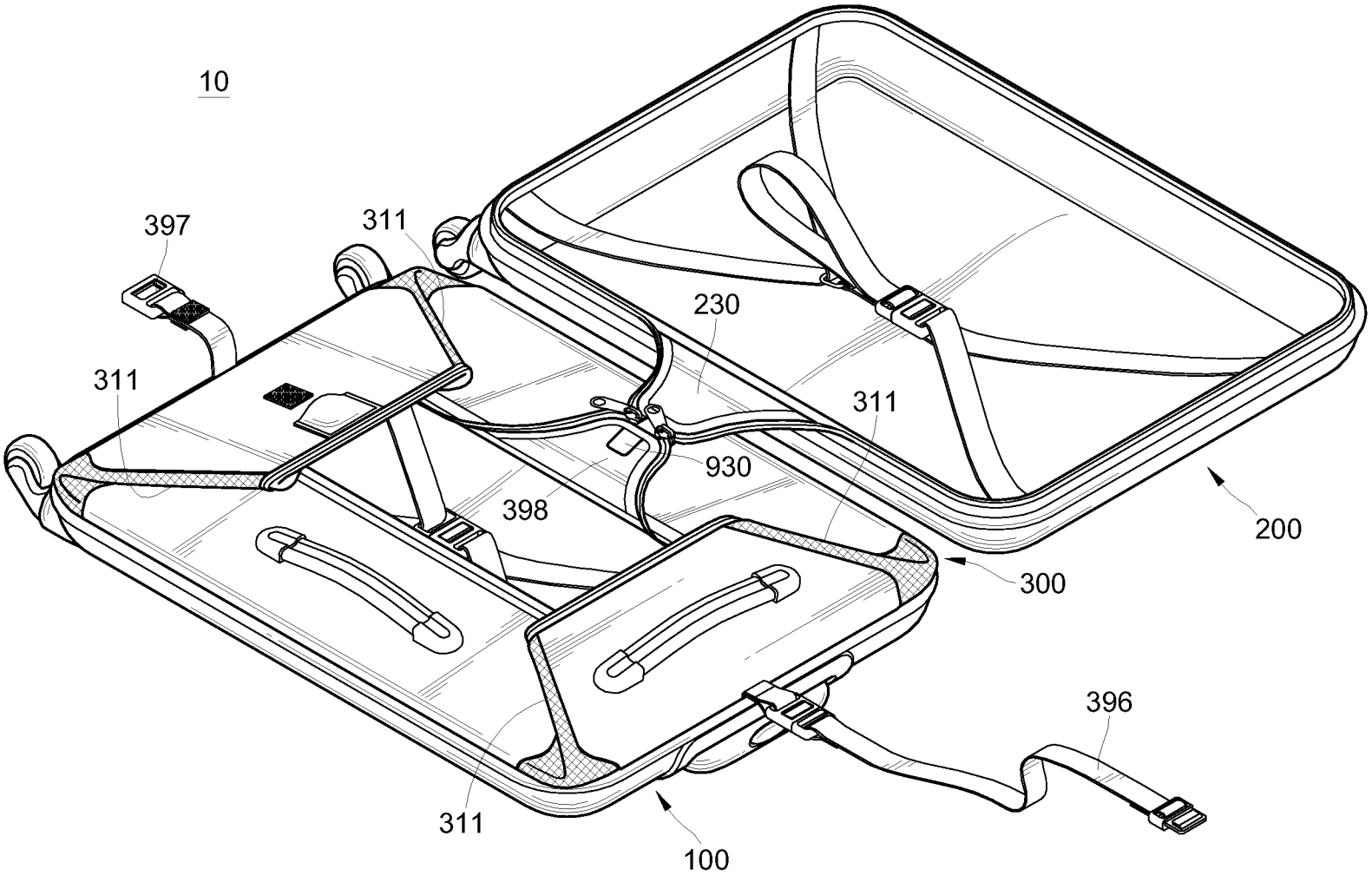
Figure 7:
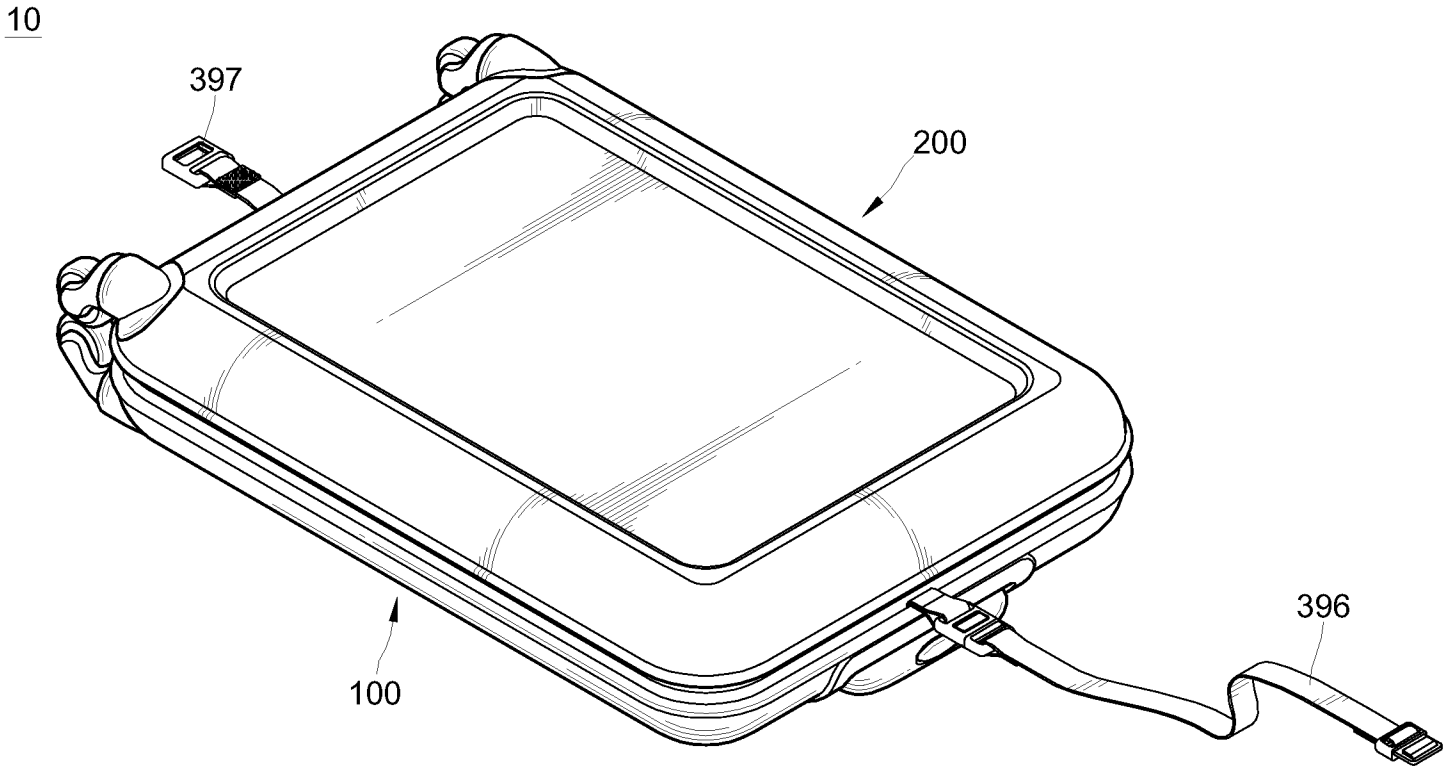
Figure 8:
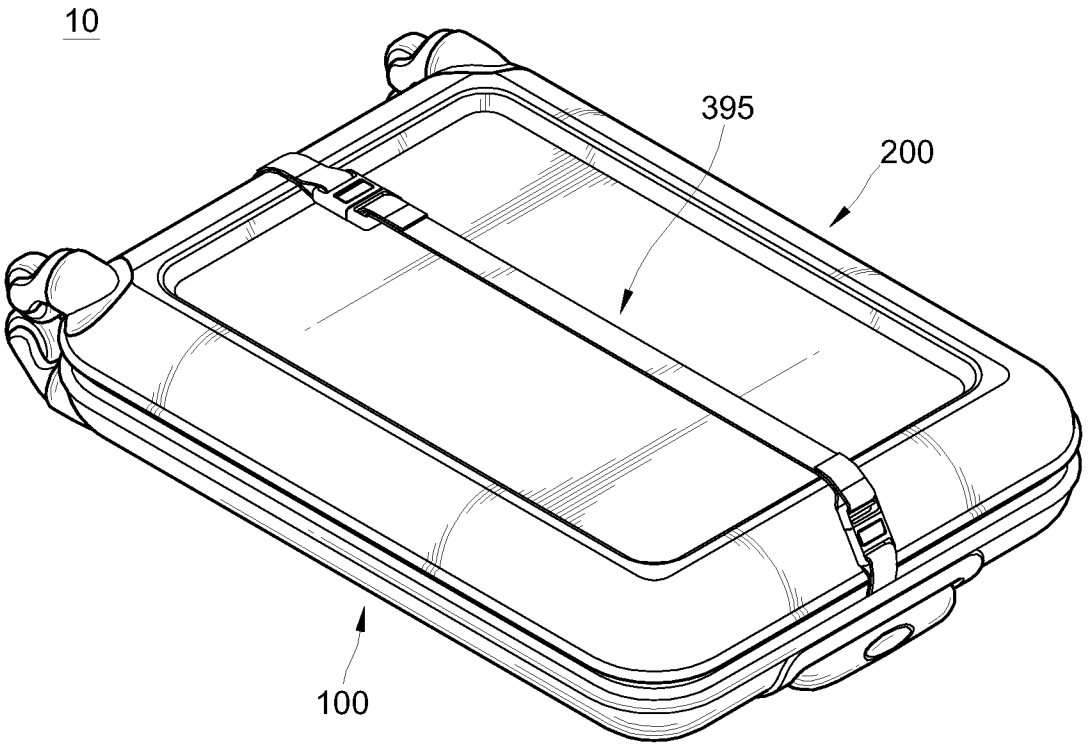

Then, as shown in FIG. 6, the rest two opposite second supporting parts 385 are folded inwardly, so as to stack each of the first supporting parts and each of the second supporting parts on the back case component 100 to be in the storage position. Subsequently, as shown in FIG. 7, the front lid component 200 is stacked on the back case component and the ring-shaped case frame 300 which has already been stored. Additionally, each of the first supporting parts 380 and each of the second supporting parts 385 are fixed to the storage position. Lastly, as shown in FIG. 8, the first belt body 396 and the second belt body 397 are buckled up to tie the back case component 100 and the front lid component 200 together. As a result, the storage process of the suitcase structure is finished. Moreover, by comparing FIG. 8 to FIG. 1, it is found that the size of the suitcase structure 10 in the storage position is significantly smaller than that of the suitcase structure 10 in the use position.

Figure 9:
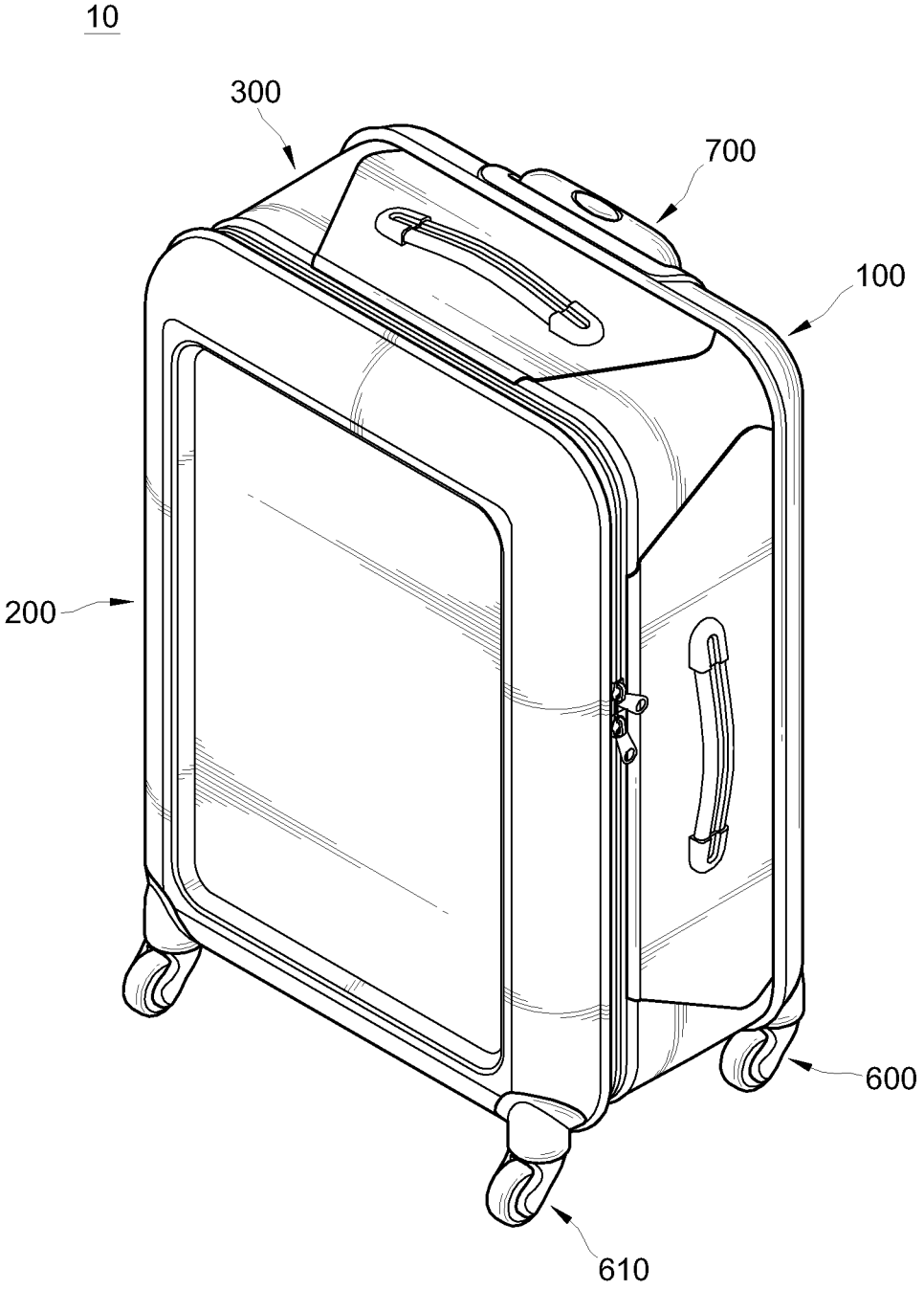
FIG. 9 is a perspective view of a suitcase structure according to a second embodiment of the disclosure.
Figure 10:
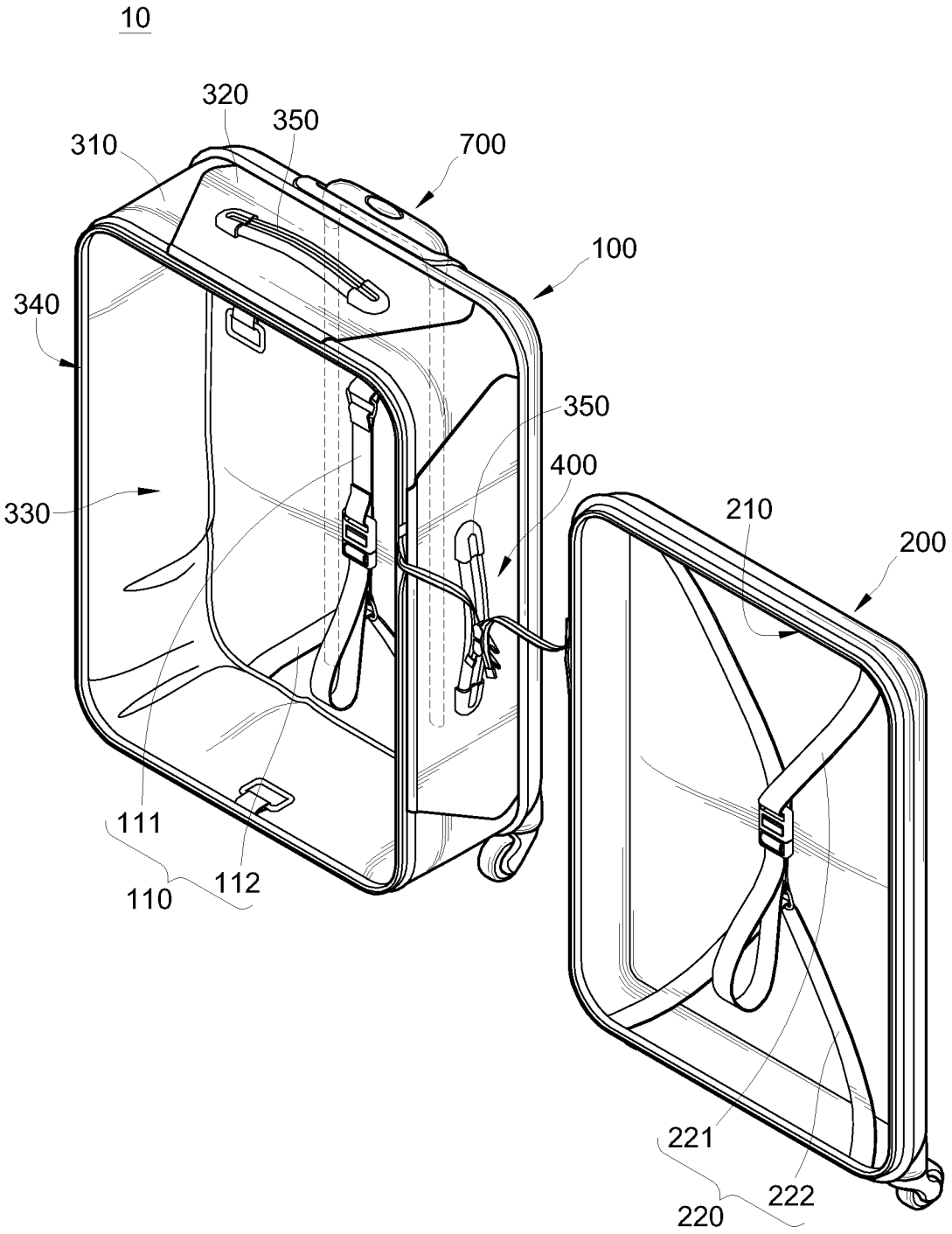
FIG. 10 is a perspective view the opened suitcase of FIG. 9.
Figure 11A:
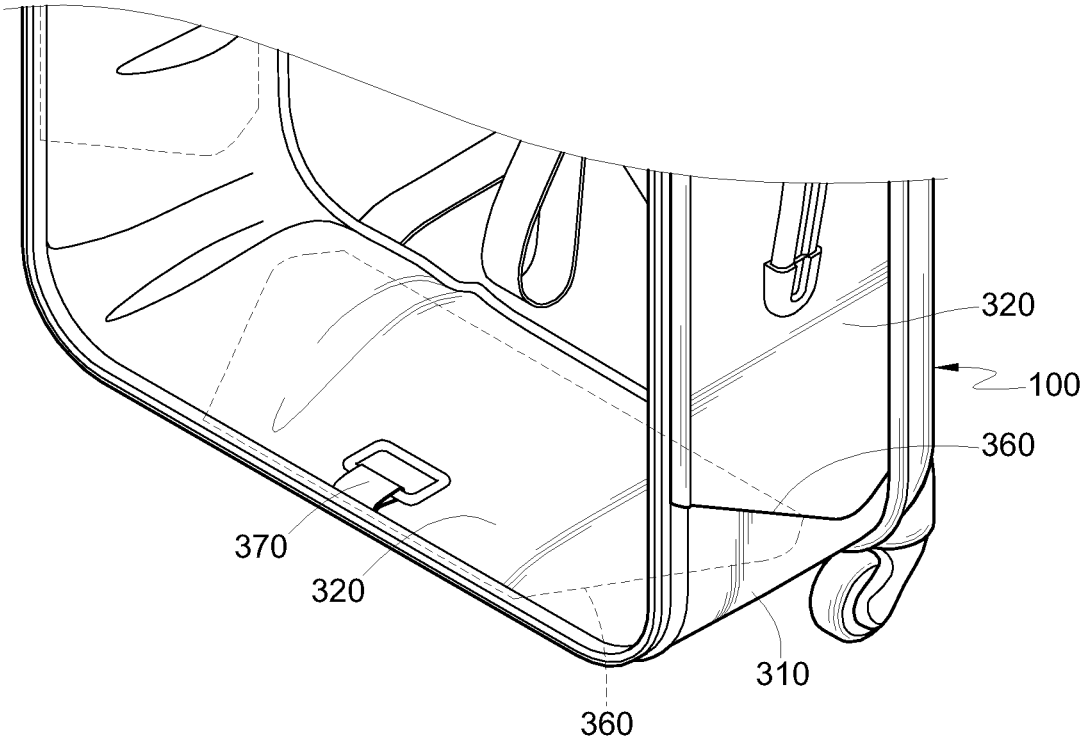
FIG. 11A is a partial enlarged view of FIG. 10.
Figure 11B:
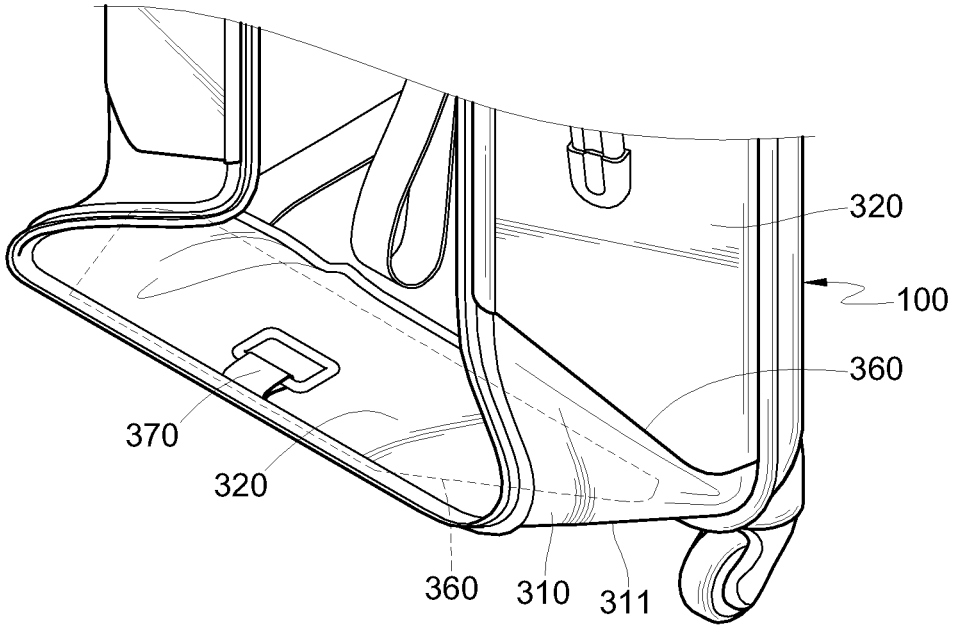
FIG. 11B is a perspective view of FIG. 11A after being bended.
Figure 12:
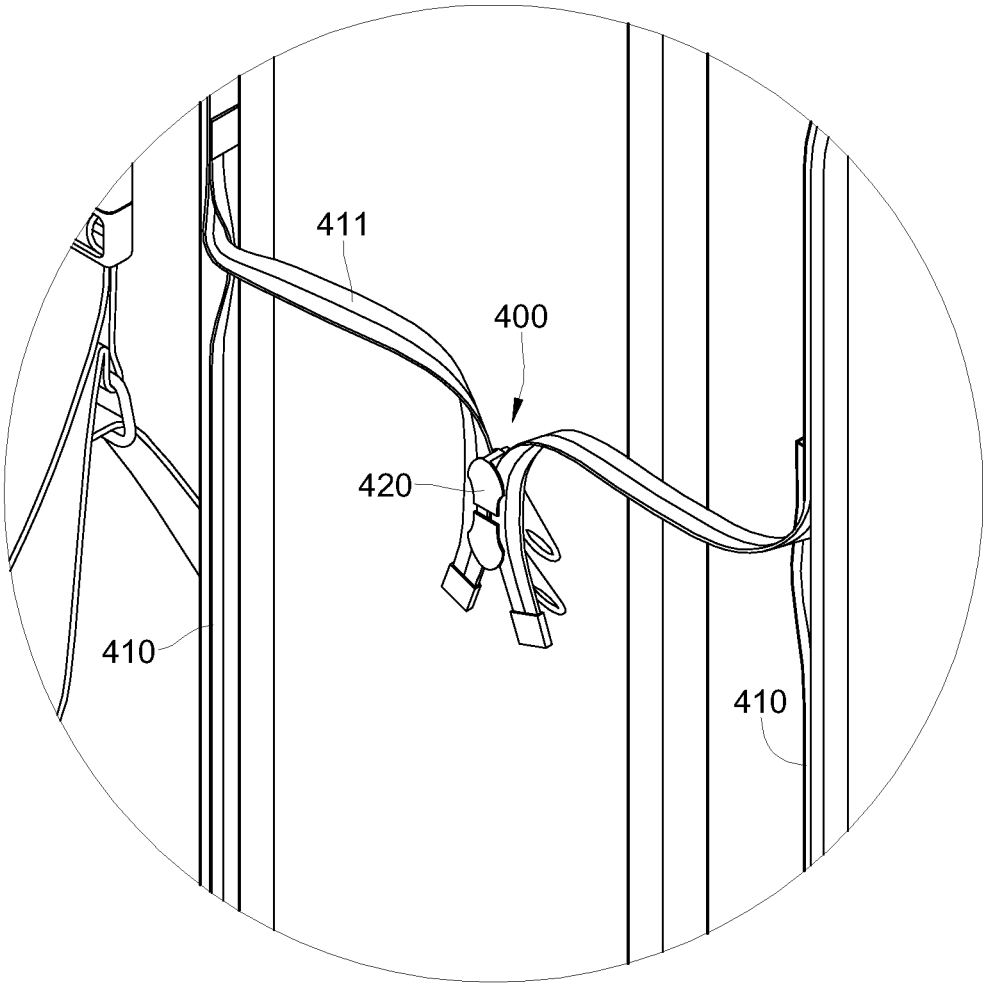
FIG. 12 is an enlarged view of the zipper part in FIG. 10.

In other embodiments, the suitcase structure 10 may have different bending structures. Please refer to FIG. 9 to FIG. 12. FIG. 9 is a perspective view of a suitcase structure according to a second embodiment of the disclosure. FIG. 10 is a perspective view the opened suitcase of FIG. 9. FIG. 11A is a partial enlarged view of FIG. 10. FIG. 11B is a perspective view of FIG. 11A after being bended. FIG. 12 is an enlarged view of the zipper part in FIG. 10.

In this embodiment, the suitcase structure 10 comprises a back case component 100, a front lid component 200 and a ring-shaped case frame 300. The back case component 100 and the front lid component 200 are made by relatively harder materials due to the better protection. For example, it is made by plastic plates such as polyethylene (PE), polypropylene (PP), EVA, PVC or ABS resin, or made by fabrics.

The opposite two sides of the ring-shaped gusset component 300 are connected to the edge of the back case component 100 and the edge of the front lid component 200 respectively, to form an accommodating space 330. Specifically, in this embodiment, the ring-shaped gusset component 300 is made by composite materials, for example, the combination of plastic plates such as PE, PP, EVA or ABS and relatively softer materials such as PU, rubber, TPU, TPR. The ring-shaped case frame 300 has a plurality of bending sections 310 and a plurality of sidewall sections 320. Each of the bending sections 310 is located at each of the end corners of the back case component 100. Each of the sidewall sections is located at each of the lateral edges of the back case component 100. Since the bending sections 310 can be made by relatively softer materials such as PU, rubber, TPU or TPR, while the inside of the sidewall section can be made by relatively harder materials, for example, the plastic plate such as PE, PP or ABS, or made by wood plate, iron frame, paper plate, aluminum plate, iron wire frame, iron plate or magnesium alloy plate. Thereby, the flexible deformation capability of each of the bending sections 310 is greater than that of each of the sidewall sections 320. The plurality of bending sections are bendable, so as to make the plurality of sidewall sections 320 be able to be stacked oppositely or erected on the back case component 100 and thereby having a storage position and a use position.

Specifically, since the flexible deformation capability of the bending section 10 is large and the bending section 10 is bendable, so users are able to bend the bending section 310 to change the form of the ring-shaped case frame 300. Thereby, the purpose of storing the suitcase structure 10 is reached. Since the flexible deformation capability of the sidewall section 320 is less than that of the bending section 310 (namely the rigidity of the sidewall section 320 is greater than that of the bending section 310), better protection and supporting effect can be achieved by the sidewall section 320. Additionally, to make each of the sidewall sections 320 be able to be stacked or erected on the back case component 100, a crease or a material with a better flexible deformation capability may be disposed between each sidewall section and each back case component 100. Thereby, each sidewall section 320 can be folded relative to the back case component 100.

Furthermore, the bending section 310 has at least one fold line 311 (as shown in FIG. 11B). The fold line 311 can be man-made, or be produced by machines (for example, by imprinting), in order to facilitate users to store or use the suitcase structure 10.

In this and some other embodiments, there are two convergence lines 360 between each of the bending sections 310 and two adjacent sidewall sections 320. The convergence line 360 may be a curve (as shown in FIG. 11A) or an arc, but the disclosure is not limited thereto. In other embodiments, the convergence line 360 may be a straight line, and the two adjacent convergence lines 360 may be parallel to each other, or be in a relation that the distance between one end of each convergence line 360 is greater than that of the other end of each convergence line 360.

Moreover, in this embodiment, the ring-shaped case frame 300 has a first opening 340, the front lid component has a second opening 210. The front lid component 200 is connected to the ring-shaped case frame 300 by a zipper 400 to form the accommodating space 330. The zipper 400 comprises two chains 410 and two zipper heads 420. The two chains 410 are disposed around the edge of the first opening 340 and the edge of the second opening 210. The two zipper heads 420 are configured for tying the two chains 410 together of separating them, so as to close or open the suitcase structure 10. However, the zipper 400 is just one of the connection structures between the front lid component 200 and the ring-shaped case frame 300. In other embodiments, the connection structure may be a Velcro or a button.

In this embodiment, one end of the two chains 410 extends and is connected to each other to form a connection section 411. The connection section 411 is located between the front lid component 200 and the ring-shaped case frame 300. Additionally, the connection section 411 has a length to enable the front lid component 200 and the ring-shaped case frame 300 to be separated from each other and be maintained a distance between them. In this embodiment, for example, the length of the connection section 411 (namely the distance between the front lid component 200 and the ring-shaped case frame 300) is greater than the width of the ring-shaped case frame 300. Thereby, a space can be vacated for users to bend the bending section 310 in order to stack each of the sidewall sections 420 on the back case component 100.

In this embodiment, the suitcase structure 10 further comprises a plurality of first wheels 600 and a plurality of second wheels 610. The plurality of first wheels 600 are disposed on the back case component 100, and the plurality of the second wheels 60 are disposed on the front lid component 200. Nevertheless, the positions and quantities of the aforementioned wheels 600 and 610 are not intended to limit the disclosure.

In this and some other embodiments, the suitcase structure further comprises at least one handle grip 350. The handle grip is disposed on the ring-shaped case frame 300. Specifically, to enable users to carry the suitcase structure 10 at different angles, two handle grips 350 can be disposed on the opposite sidewall sections 320 respectively.

In this and some other embodiments, the back case component 100 has a belt 110. The belt 110 comprises a first belt body 111 and a second belt body 112 which are able to be separated from each other and be connected with each other. When the first belt body 111 and the second belt body 112 are connected with each other, they are configured for surrounding the back case component 100 and the stored ring-shaped case frame 300, to make the back case component 100 and the ring-shaped case frame 300 close to the front lid component 200. Nonetheless, the belt 110 can not only be used to tighten the back case component 100 and the ring-shaped case frame 300, but also be used to constrain the goods stored inside the back case component 100 and the ring-shaped case frame 300. Consequently, the front lid component 200 further comprises a belt 220. The belt 220 comprises a first belt body 221 and a second belt body 222. The first belt body 221 and the second belt body 222 are located on opposite two sides of the front lid component 200 respectively. The first belt body 221 and the second belt body 222 are connected to constrain the goods inside the front lid component 200.

In this and some other embodiments, the ring-shaped case frame 300 further comprises two retaining rings 370. The two retaining rings 370 are located on two opposite sides of the first opening respectively. The first belt body 111 and the second belt body 112 of the belt 110 of the back case component 100 are configured for passing through the two retaining rings 370 and being connected to each other.

Figure 13:
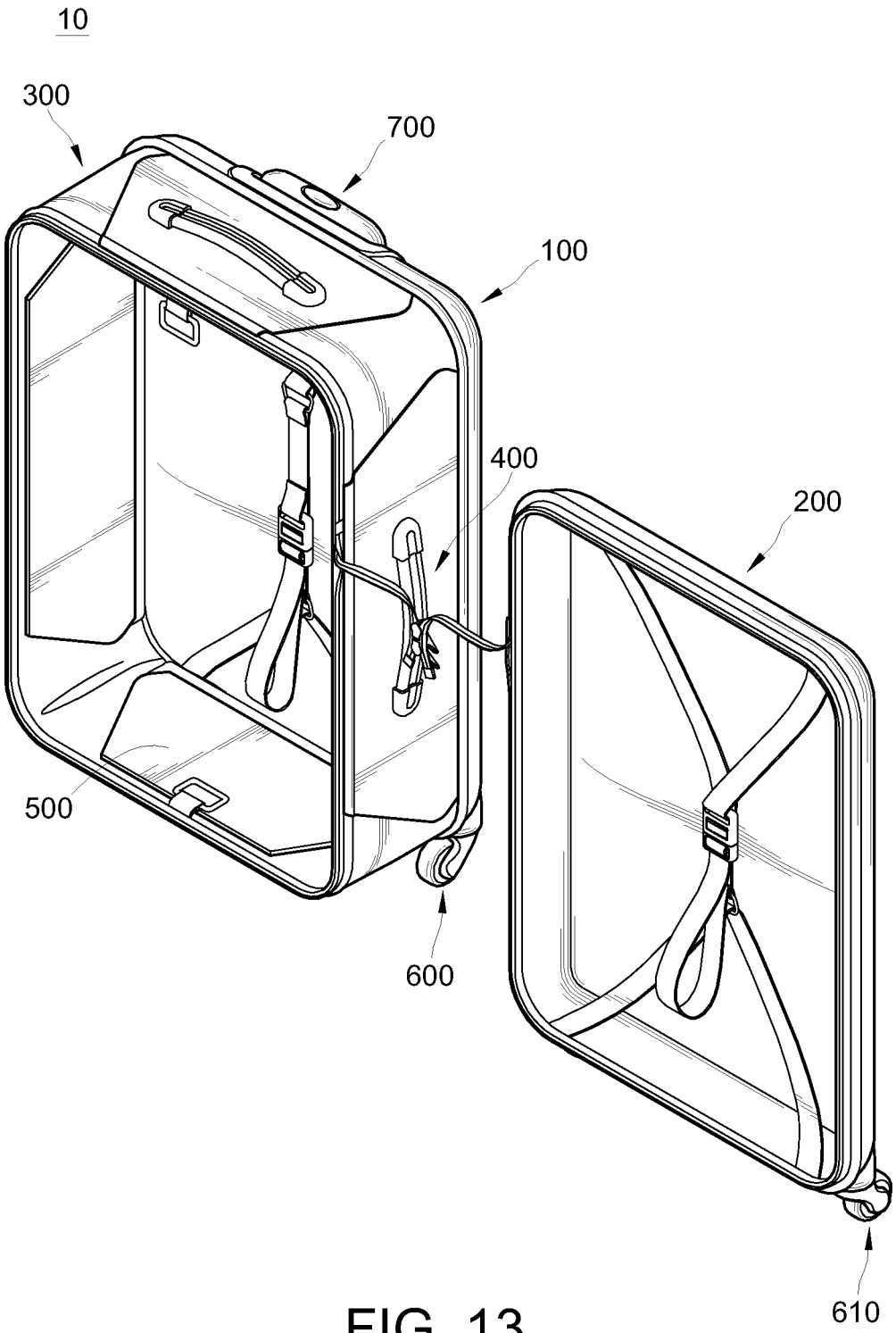
FIG. 13 is a perspective view of an opened suitcase structure according to a third embodiment of the disclosure.

Please refer to FIG. 13. FIG. 13 is a perspective view of an opened suitcase structure according to a third embodiment of the disclosure. In this embodiment, the suitcase structure 10 further comprises at least one honeycomb board 500. The honeycomb board 500 is fixed to the ring-shaped gusset component 300, and is configured for supporting the ring-shaped gusset component 300. Thereby, the structural strength of the suitcase structure 10 can be enhanced. However, in other embodiments, the honeycomb board 500 may be replaced by other components having stronger structural strength than the ring-shaped gusset component 300, such as an iron wire frame, a wood plate, a plastic plate, an iron plate, an aluminum plate, rubber, or a magnesium alloy plate.

The storage process of the suitcase structure of this embodiment is illustrated hereinafter. Please refer to FIG. 10 and FIG. 14 to FIG. 17. FIG. 14 to FIG. 17 are schematic views of the storage process of FIG. 10.

Figure 14:
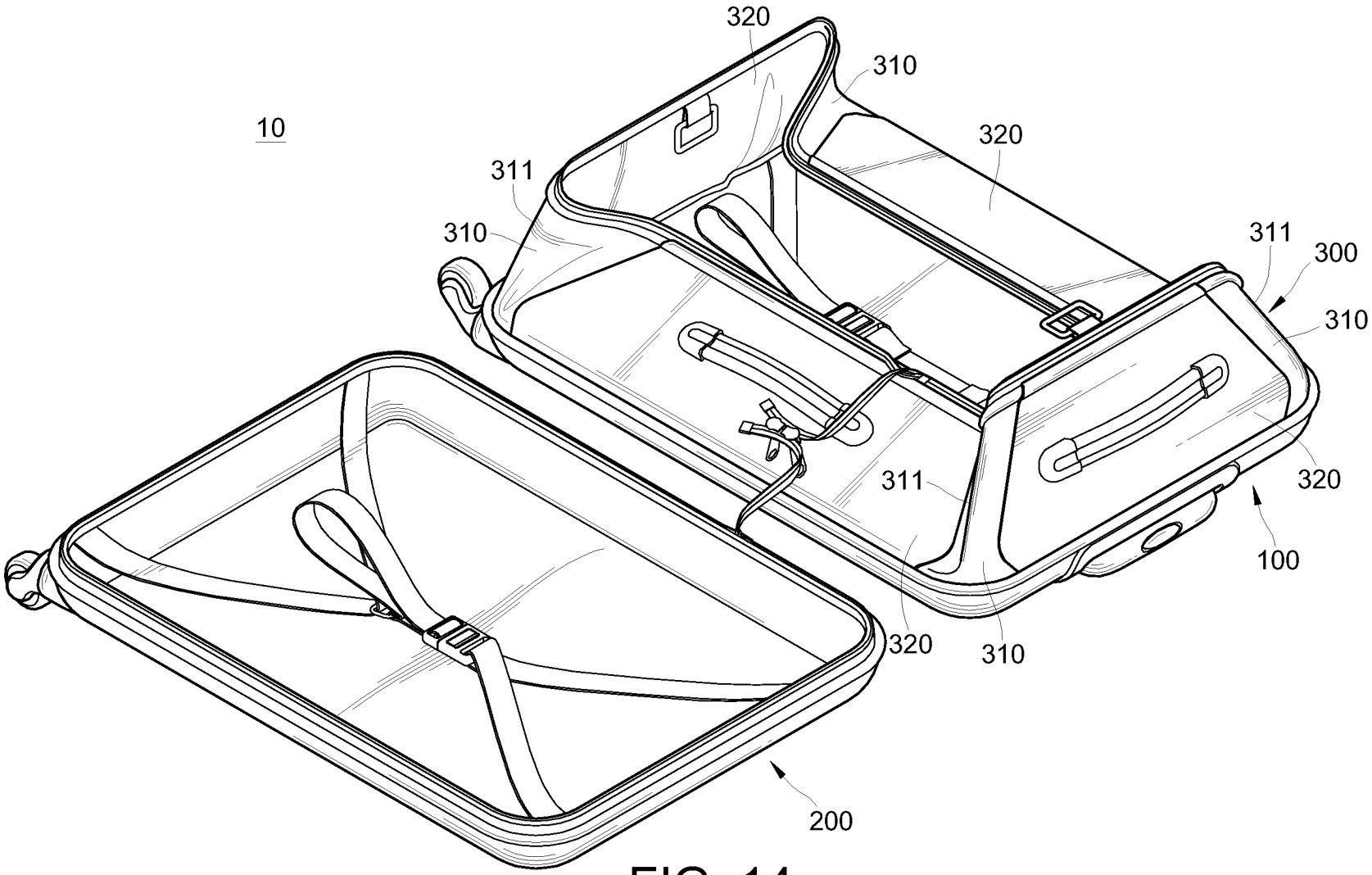
FIG. 14 to FIG. 17 are schematic views of the storage process of FIG. 10.

At first, as shown in FIG. 10, the ring-shaped gusset component 300 is erected oppositely on the back case component 100 and therefore is in the use position. At this point, goods can be stored in the accommodating space 330. Then, the process of folding the ring-shaped gusset component 300 begins. As shown in FIG. 14, the two opposite sidewall sections 320 are first pressed inwardly to form the fold line 311. Since four bending sections 310 connected to the two sidewall sections 320 are bendable, the two sidewall sections 320 can be stacked on the back case component 100.

Figure 15:
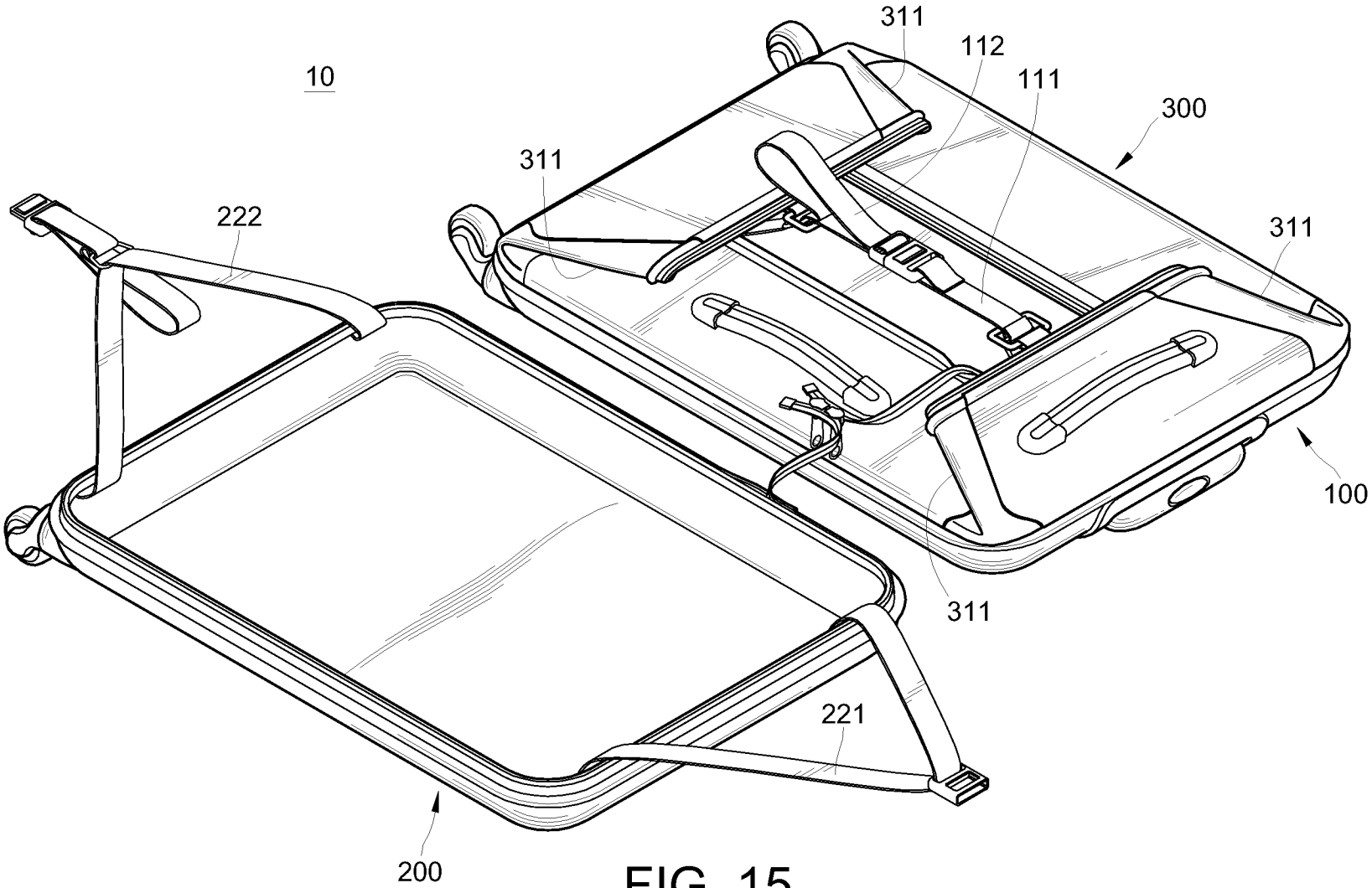
Figure 16:
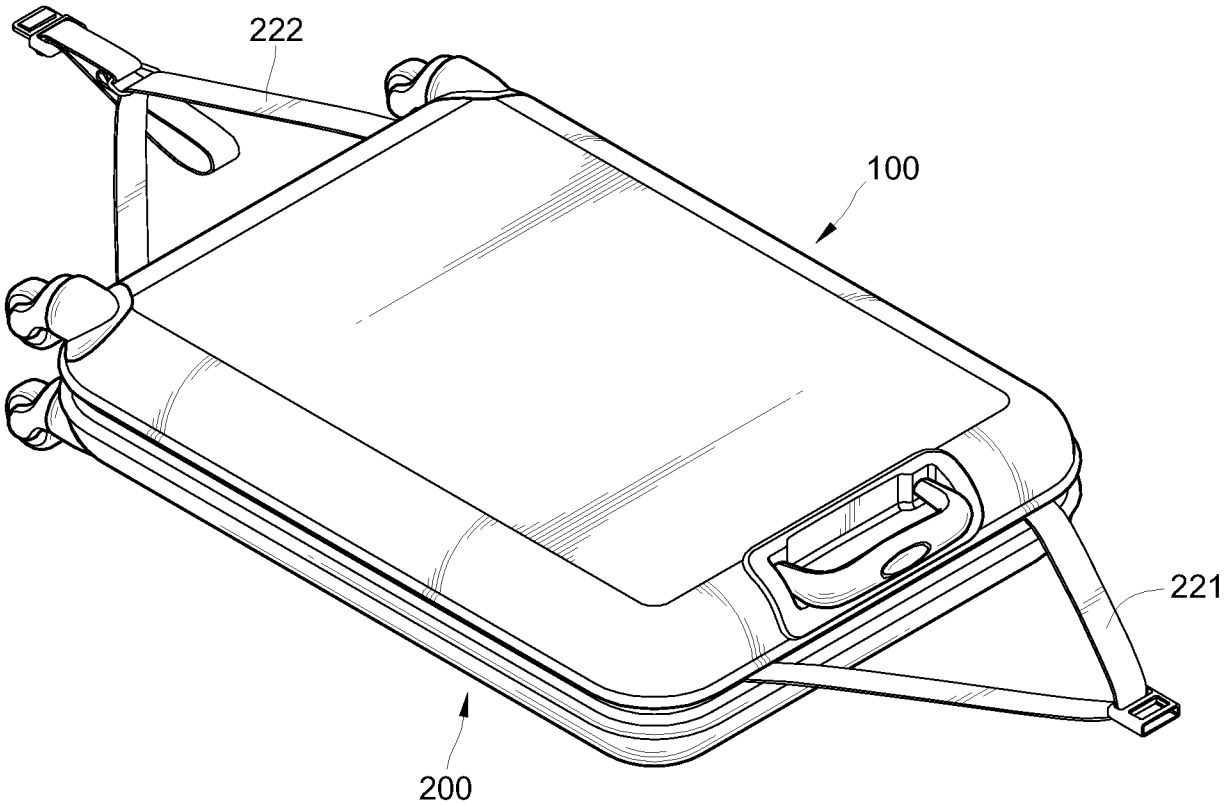
Figure 17:
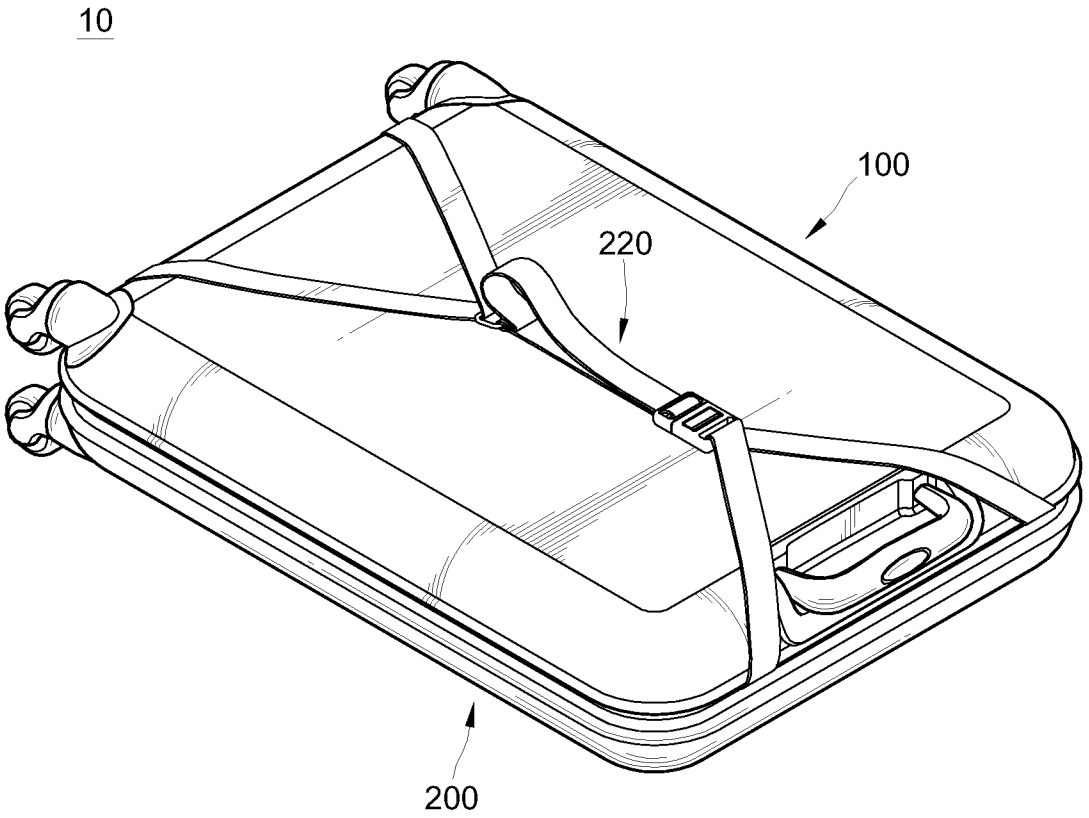

Then, as shown in FIG. 15, the rest two opposite sidewall sections 320 are folded inwardly, so as to stack each of the sidewall sections 320 on the back case component 100 in order to be in the storage position. Additionally, the first belt body 111 and the second belt body 122 of the belt 110 can be disposed through and connected, as shown in FIG. 16, in which the back case component 100 and the ring-shaped gusset component 300 which has already been stored are stacked on the front lid component 200. Lastly, as shown in FIG. 17, the first belt body 221 and the second belt body 222 of the belt 220 are connected with each other, so as to finish the storage process of the suitcase structure 10. Furthermore, by comparing FIG. 17 to FIG. 9, it is found that the size of the suitcase structure 10 at the storage position is significantly less than that of the suitcase structure 10 at the use position.

Figure 18:
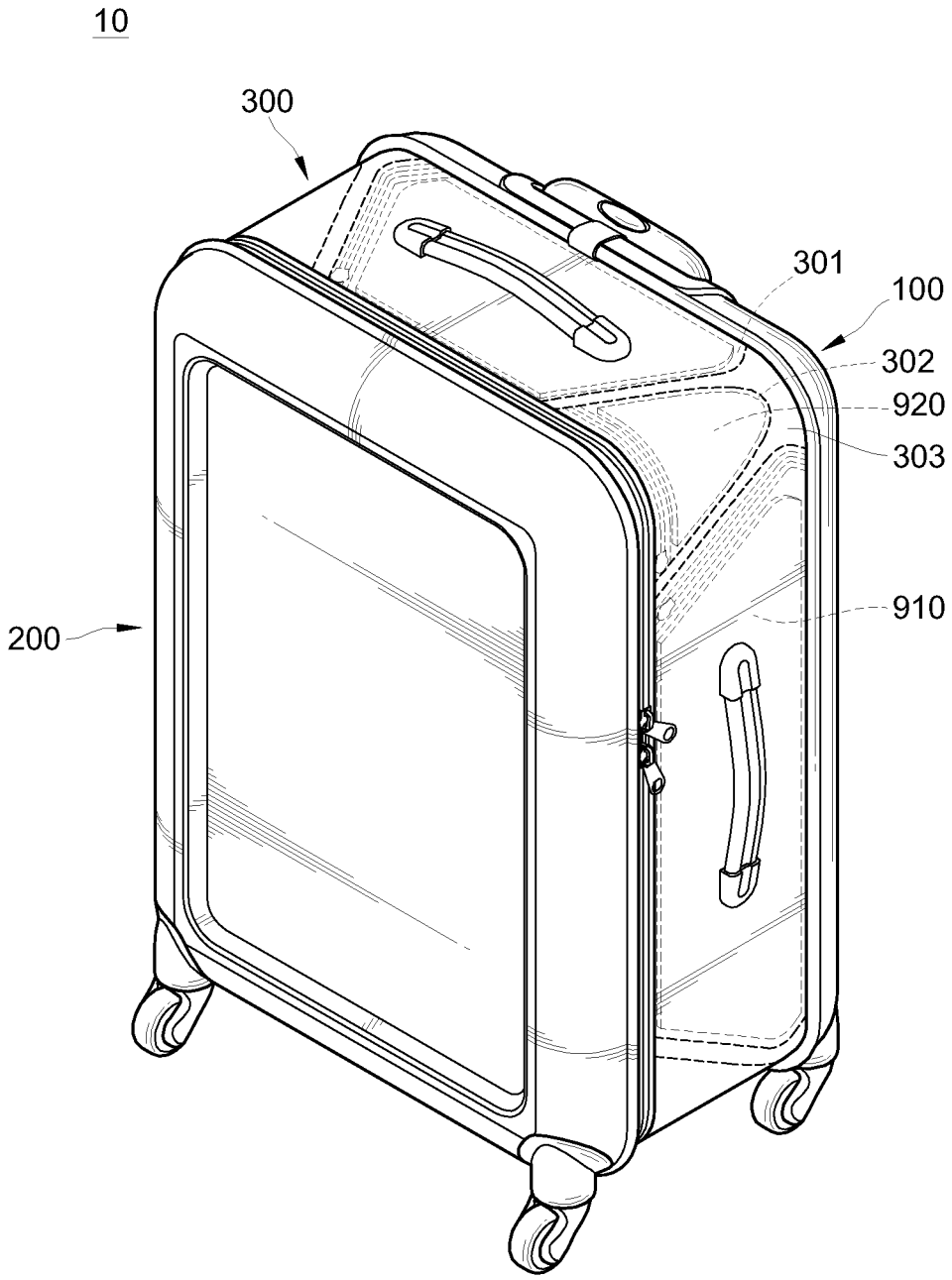
FIG. 18 is a perspective view of a suitcase structure according to a fourth embodiment of the disclosure.

Please refer to FIG. 18. FIG. 18 is a perspective view of a suitcase structure according to a fourth embodiment of the disclosure.

In this embodiment, a suitcase structure 10 comprises a back case component 100, a front lid component 200 and a ring-shaped gusset component 300. The back case component 100 and the front lid component 200 are made by relatively harder materials due to the better protection. For example, they are made by plastic plates such as polyethylene (PE), polypropylene (PP), EVA or ABS resin, or made by fabrics.

The two opposite sides of the ring-shaped gusset component 300 are connected to the edge of the back case component 100 and the edge of the front lid component 200, so as to form an accommodating space 330. The ring-shaped gusset component 300 has a plurality of first accommodating parts 301, a plurality of second accommodating parts 302, a plurality of first reinforcement elements 910 and a plurality of second reinforcement elements 920. The plurality of first accommodating parts 301 are each located at each side edge of the back case component 100. The plurality of second accommodating parts 302 are each located at each end corner of the back case component 100. Each of the first accommodating parts 301 and each of the second accommodating parts 302 kept apart by a distance. The plurality of first reinforcement elements 910 are detachably disposed on the plurality of first accommodating parts 301 respectively. The plurality of second reinforcement elements 920 are each detachably disposed on the second accommodating part 302, so as to form a plurality of bending parts 303 between the first accommodating part and the second accommodating part. In this embodiment, the first reinforcement elements 910 and the second reinforcement elements 920 are plates whose hardness is greater than that of the first accommodating part 301 and the second accommodating part 302, but the disclosure is not limited thereto. In other embodiments, the first reinforcement elements 910 and the second reinforcement elements 920 may be iron wire frames, wood plates, plastic plates, iron plates, aluminum plates, paper plates, rubber or magnesium alloy plates. In this embodiment, the ring-shaped gusset component 300 has the first accommodating part 301 and the second accommodating part 302, but the disclosure is not limited thereto. In other embodiments, the ring-shaped gusset component 300 may just have the first accommodating part 301. The plurality of first reinforcement elements 910 are disposed on the first accommodating part 301 respectively, so as to from a plurality of bending parts 303 between each of the first accommodating parts 301.

Since each of the accommodating parts 301 and 302 dispose reinforcement elements 910 and 920 respectively. As a result, the hardness thereof is enhanced so that the protection effect regarding goods inside the suitcase structure 10 is improved. Since each of the bending parts 303 is not equipped with each of the reinforcement elements 910 and 920, the flexible deformation capability of each of the bending parts 303 is greater than that of each of the first accommodating parts 301 and each of the second accommodating parts 302. The plurality of bending parts 303 are bendable, so as to enable the plurality of second accommodating parts 302 to be stacked oppositely or erected on the back case component 100.

In the aforementioned suitcase structure, since the ring-shaped gusset component consists of the plurality of bending parts with different flexible deformation capabilities and the plurality of supporting parts. Additionally, each of the bending parts is bendable. Thereby, users may fold each of the supporting parts inwardly and stack thereof on the back case component. By doing this, the size of the suitcase structure after being folded is much smaller than the size of the suitcase structure before being folded, therefore facilitating the storage of the suitcase structure.

Moreover, since the ring-shaped gusset component consists of the plurality of bending sections with two different flexible deformation capabilities and the plurality of sidewall sections. Each of the bending sections is bendable, so that users may fold each of the sidewall sections inwardly and stack them on the back case component. Thereby, the size of the suitcase structure after being folded is much smaller than the size of the suitcase structure before being folded, therefore facilitating the storage of the suitcase structure.

Furthermore, since the structural strength of the honeycomb plate is stronger than that of the ring-shaped gusset component, the overall structural strength of the suitcase structure can be improved.

Additionally, a connection section is extended from the zipper of the suitcase structure, so the front lid component and the ring-shaped gusset component can be kept apart by a distance, so as to ensure that the front lid component does not disturb that users fold the ring-shaped gusset component.

What is claimed is:

1. A suitcase structure, comprising:

a back case component having a plurality of end corners and plurality of lateral edges;

a front lid component; and a ring-shaped gusset component, the opposite sides of the ring-shaped gusset component being connected with the edge of the back case component and the edge of the front lid component, so as to form an accommodating space, the ring-shaped gusset component having a plurality of first supporting parts and a plurality of second supporting parts connected with each other, the plurality of first supporting parts being each located at each of the end corners of the back case component, the plurality of second supporting parts being each located at each of the lateral edges of the back case component, wherein the ring-shaped gusset component has a plurality of bending parts, the plurality of bending parts are each located between the plurality of first supporting parts and the plurality of second supporting parts, the flexible deformation capability of each of the bending parts is greater than the flexible deformation capability of each of the first supporting parts and each of the second supporting parts, and the plurality of bending parts are bendable, making the plurality of first supporting parts and the plurality of second supporting parts be capable of being stacked oppositely or being erected on the back case component.

2. The suitcase structure according to claim 1, wherein each of the bending parts extending from the back case component to the front lid component.

3. The suitcase structure according to claim 1, wherein the first supporting part is made by a PVC layer, a EVA layer, a PP ply, a sugar cane cloth layer, a neoprene layer and a PVC bottom layer which are stacked up, and the second supporting part is made of a PVC layer, a EVA layer and a PP ply which are stacked up.

4. The suitcase structure according to claim 1, wherein the ring-shaped gusset component further comprises a belt, the belt comprises a first belt body and a second belt body, the first belt body is detachably disposed on the outer lateral side of the ring-shaped gusset component, and the second belt body is disposed on the outer lateral side of the ring-shaped gusset component.

5. The suitcase structure according to claim 1, wherein the front lid component has a belt, the belt is configured for surrounding the back case component and the ring-shaped gusset component, so as to cause the back case component and the ring-shaped gusset component to close the front lid component.

6. The suitcase structure according to claim 1, wherein the front lid component and the ring-shaped gusset component are connected by a connection structure, so as to form the accommodating space.

7. The suitcase structure according to claim 6, wherein the connection structure is a zipper.

8. The suitcase structure according to claim 7, wherein the ring-shaped gusset component has a first opening, the front lid component has a second opening, the zipper comprises two chains and a zipper head, the two chains are disposed on the edge of the first opening and the edge of the second opening respectively, one end of the two chains extends and forms a connection section, the zipper head is configured for tying the two chains together or separating the two chains.

9. The suitcase structure according to claim 7, wherein ring-shaped gusset component has a first opening and comprises a first extending part, the first extending part is connected to the ring-shaped gusset component to form the edge of the first opening, the front lid component has a second opening and comprises a second extending part, the second extending part is connected to the front lid component to form the edge of the second opening, and the zipper comprises two zippers and two zipper heads, wherein one of the two zippers is disposed around the edge of the first opening and the edge of the first extending part, and the other zipper is disposed around the edge of the second opening and the edge of the second extending part.

10. The suitcase structure according to claim 9, further comprising a gripping part, the gripping part is connected to a second extending part.

* * * * *